US008729817B2

(12) United States Patent
Guleria et al.

(10) Patent No.: US 8,729,817 B2
(45) Date of Patent: May 20, 2014

(54) LATCHING CIRCUIT FOR BALLAST

(71) Applicant: Osram Sylvania Inc., Danvers, MA (US)

(72) Inventors: Ashwani Guleria, Haryana (IN); Ashish Kumar Gupta, Lucknow U.P. (IN)

(73) Assignee: OSRAM SYLVANIA Inc., Danvers, MA (US)

( * ) Notice: Subject to any disclaimer, the term of this patent is extended or adjusted under 35 U.S.C. 154(b) by 98 days.

(21) Appl. No.: 13/658,636

(22) Filed: Oct. 23, 2012

(65) Prior Publication Data

US 2014/0111089 A1 Apr. 24, 2014

(51) Int. Cl.

*H05B 37/02* (2006.01)
*H05B 41/298* (2006.01)
*H05B 41/285* (2006.01)

(52) U.S. Cl.

CPC ..... *H05B 41/2986* (2013.01); *H05B 41/2856* (2013.01)
USPC ..... 315/225; 315/297; 315/352

(58) Field of Classification Search

CPC ..... H05B 41/46; H05B 33/0815; H05B 41/2985–41/2986; H05B 41/2988; H05B 41/2855–41/2856; H05B 41/2858
USPC ..... 315/121, 200 R, 201, 224–225, 291, 315/294, 297, 307, 326, 249, 352
See application file for complete search history.

(56) References Cited

U.S. PATENT DOCUMENTS

| | | | | |
|---|---|---|---|---|
| 5,770,925 | A | 6/1998 | Konopka et al. | |
| 5,869,935 | A * | 2/1999 | Sodhi | 315/225 |
| 6,768,274 | B2 * | 7/2004 | Konopka et al. | 315/291 |
| 7,312,588 | B1 * | 12/2007 | Yu et al. | 315/291 |
| 7,348,734 | B2 * | 3/2008 | Yadlapalli | 315/224 |
| 8,093,839 | B2 * | 1/2012 | Jin et al. | 315/308 |
| 2004/0061453 | A1 | 4/2004 | Konopka et al. | |

FOREIGN PATENT DOCUMENTS

EP 2257133 A2 1/2010

* cited by examiner

*Primary Examiner* — Jason M Crawford
(74) *Attorney, Agent, or Firm* — Shaun P. Montana

(57) ABSTRACT

A ballast including a latching circuit is provided. The ballast includes an inverter circuit for providing an oscillating voltage signal to energize a lamp set, a control circuit for controlling operation of the inverter circuit, and a voltage supply circuit for providing a supply voltage to the control circuit. The ballast also includes a fault detection circuit for detecting a fault condition and a latching circuit connected to the fault detection circuit. The latching circuit is configured to drain the supply voltage and thereby disable the control circuit so that operation of the inverter circuit is discontinued during a fault condition.

18 Claims, 4 Drawing Sheets

LATCHING CIRCUIT FOR BALLAST

TECHNICAL FIELD

The present invention relates to lighting, and more specifically, to electronic circuits for light sources.

BACKGROUND

Electronic ballasts are subject to many safety standards, including the capability of preventing from electric shock through lamp leakage current. In order to reduce the risk of electric shock during re-lamping, a ballast is typically required to comply with the safety standard recited in UL 935 section 24. This standard requires ballast operation to cease if a lamp leakage fault is detected and leakage current is more than a prescribed limit. Typically, operation of the ballast is ceased by discontinuing the operation of the inverter circuit within the ballast.

Some ballasts include an inverter that continues to attempt to restart a lamp after occurrence of a fault, to avoid having to toggle input power to the ballast in order to ignite the lamp. One such example is a ballast available from OSRAM SYLVANIA Inc. of Danvers, Mass., which use an integrated circuit from Infineon Technologies. This feature helps in cases of false detection of a fault, and in cases where a ballast initially fails to ignite the lamp(s) to which it is connected.

SUMMARY

Conventional ballasts, such as those described above, suffer from a key deficiency, namely that the combination of an inverter shut down feature with the restart feature typically prevents the ballast from being adapted for use with multiple lamps. What is needed, therefore, is a ballast with automatic restart following relamping and fault detection capabilities, which also terminates the operation of the inverter in the event that a fault is detected. The inverter would then remain inoperative until the fault is corrected.

Embodiments of the present invention provide such a ballast, which includes a latching circuit that renders an inverter circuit inoperative while a fault is detected. More particularly, the ballast includes a lamp driver circuit having an inverter circuit that drives a set of lamps. A control circuit is connected to the lamp driver circuit, and controls the operation of the lamp driver circuit. A voltage supply circuit powers the control circuit. A fault detection circuit is connected to the set of lamps, and detects the occurrence of a fault condition, which triggers generation of a voltage pulse. The voltage pulse is sent to the latching circuit, which upon receiving the pulse, disables the control circuit via disabling the voltage supply circuit. This discontinues operation of the inverter circuit when a fault is detected. More particularly, the latching circuit includes three switches, each having a conductive ("ON") and a non-conductive ("OFF") state. These switches are configured to drain the supply voltage that powers the control circuit in response to receiving the voltage pulse.

In an embodiment, there is provided a ballast. The ballast includes: a rectifier configured to receive an alternating current (AC) voltage signal from a power source and to produce a rectified voltage signal therefrom; an inverter circuit configured to receive the rectified voltage signal and to provide an oscillating voltage signal to energize one or more lamps; a control circuit connected to the inverter circuit and configured to control operation of the inverter circuit; a voltage supply circuit connected to the control circuit and configured to provide a supply voltage to the control circuit so as to power the control circuit; a fault detection circuit connected to the one or more lamps and configured to detect a fault condition and, in response, to generate a voltage pulse; and a latching circuit connected to the fault detection circuit and configured to disable the control circuit so that operation of the inverter circuit is discontinued during a fault condition, the latching circuit including: a first switching circuit comprising a first switch, wherein the first switching circuit is connected to the rectifier and is configured to receive the rectified voltage signal from the rectifier, wherein the first switch includes a conductive state and a non-conductive state, and wherein the first switch is connected to the fault detection circuit and configured to switch states in response to receiving the voltage pulse from the fault detection circuit; a second switching circuit comprising a second switch, wherein the second switching circuit is connected to the first switching circuit and to the rectifier and is configured to receive the rectified voltage signal, wherein the second switch includes a conductive state and a non-conductive state, and wherein the second switch and the first switch are configured to operate complementary relative to each other between the conductive state and the non-conductive state; and a third switch having a conductive state and a non-conductive state, wherein the third switch is connected to the second switch so that the state of the third switch is a function of the state of the second switch, and wherein the third switch is connected to the voltage supply circuit so that the supply voltage to the control circuit is drained when the third switch operates in the conductive state and the control circuit is thereby disabled.

In a related embodiment, the ballast may further include: a relamping circuit configured to detect a relamping event and generate a voltage pulse in response to so detecting, the relamping circuit connected to the second switch of the latching circuit to provide the voltage pulse thereto, wherein the second switch of the latching circuit may be configured to switch states in response to receiving the voltage pulse from the relamping circuit.

In another related embodiment, the first switching circuit may further include a first resistor-capacitor (RC) circuit having a first time constant, and the second switching circuit may further include a second RC circuit having a second time constant. In a further related embodiment, the first time constant may be less than the second time constant.

In yet another related embodiment, the fault detection circuit may include a power ground node and an earth ground node, and the fault detection circuit may be configured to detect a fault condition based on current flow between the power ground node and the earth ground node. In a further related embodiment, the earth ground node of the fault detection circuit may be connected to the rectifier.

In still another related embodiment, the first switch may be configured to switch from a conductive state to a non-conductive state in response to receiving the voltage pulse from the fault detection circuit. In yet still another related embodiment, the latching circuit may be configured so that the second switch and the third switch change from a non-conductive state to a conductive state in response to detection of a fault condition by the fault detection circuit. In still yet another related embodiment, the ballast may be configured to connect to a first lamp and a second lamp, and the one or more lamps may include the first lamp and the second lamp.

In another embodiment, there is provided a ballast. The ballast includes: a lamp driver circuit configured to drive one or more lamps; a control circuit connected to the lamp driver circuit to control operation of the lamp driver circuit; a voltage supply circuit connected to the control circuit to provide a supply voltage to the control circuit to power the control circuit; a fault detection circuit configured to connect to the one or more lamps to detect a fault condition and generate a voltage pulse in response to so detecting; and a latching circuit connected to the fault detection circuit to disable the control circuit so that operation of the lamp driver circuit is discontinued during a fault condition, the latching circuit including: a pair of complementary switches, wherein the pair of complementary switches comprises a first switch and a second switch; and a third switch configured to operate between a conductive state and a non-conductive state as a function of the second switch, wherein the third switch is connected to the voltage supply circuit so that the supply voltage to the control circuit is drained when the third switch operates in the conductive state and the control circuit is thereby disabled.

In a related embodiment, the first switch and the second switch may each operate between a conductive state and a non-conductive state, and the first switch may be connected to the fault detection circuit and configured to switch states in response to receiving the voltage pulse from the fault detection circuit.

In another related embodiment, the lamp driver circuit may be configured to drive a first lamp and a second lamp. In still another related embodiment, the ballast may further include a rectifier to receive an alternating current (AC) voltage signal from a power source and provide a rectified voltage signal to the lamp driver circuit. In a further related embodiment, the ballast may further include a first resistor-capacitor (RC) circuit and a second RC circuit, wherein the first RC circuit may be connected to the rectifier and to the first switch of the latching circuit, and wherein the second RC circuit may be connected to the rectifier and to the second switch of the latching circuit. In a further related embodiment, the first RC circuit may have a first time constant, and the second RC circuit may have a second time constant that is greater than the first time constant.

In yet another related embodiment, the ballast may further include a relamping circuit to detect a relamping event and generate a voltage pulse in response to the detecting, the relamping circuit connected to the second switch of the latching circuit to provide the voltage pulse thereto, wherein the second switch of the latching circuit may be configured to turn-off in response to receiving the voltage pulse from the relamping circuit.

In still yet another related embodiment, the fault detection circuit includes a power ground node and an earth ground node, and the fault detection circuit may be configured to detect a fault condition based on current flow between the power ground node and the earth ground node. In yet still another related embodiment, the first switch may be configured to switch from a conductive state to a non-conductive state in response to receiving the voltage pulse from the fault detection circuit.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
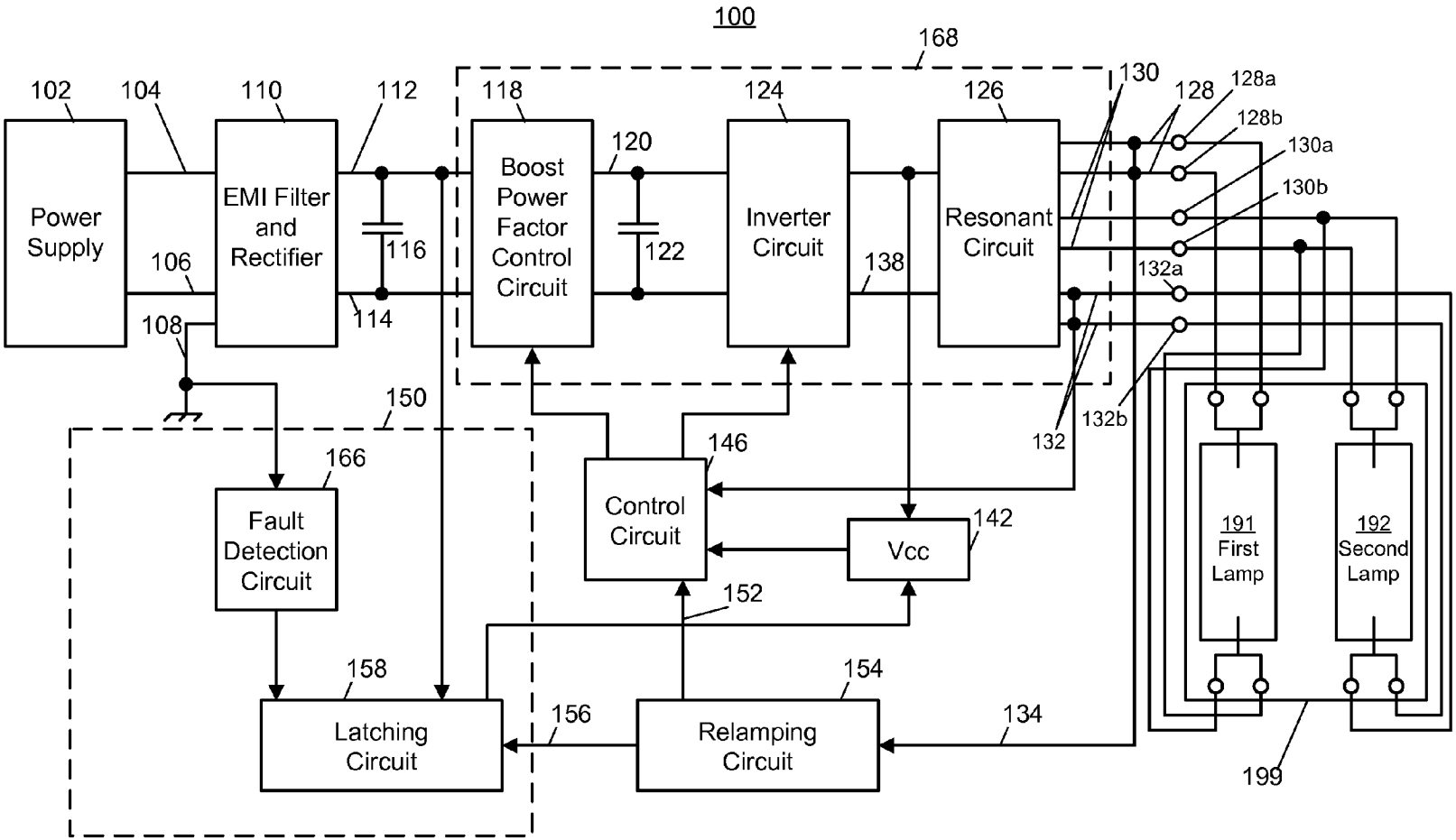
FIG. 1 shows a block diagram of an electronic ballast including a fault detection circuit, a latching circuit, and a relamping circuit, according to embodiments disclosed herein.

FIG. 1 shows an electronic ballast 100 (hereinafter also referred to a ballast 100) for powering a lamp set 199. The lamp set 199 includes one or more lamps. In FIG. 1, the ballast 100 is configured to power a lamp set 199 having a first lamp 191 and a second lamp 192, such as but not limited to two fluorescent lamps. However, any number and/or types of lamps may be used with the ballast 100 without departing from the scope of the invention. The ballast 100 includes a high voltage terminal (i.e., line voltage input terminal) 104 adapted for connecting to an alternating current (AC) power supply 102 (e.g., standard 120V AC household power). The ballast 100 also includes a neutral terminal 106, and an earth ground terminal 108 connectable to earth ground. The ballast 100 receives an input AC power signal from the AC power supply 102 via the high voltage terminal 104. When the ballast 100 is connected to the power supply 102 and to the lamp set, the ballast 100, the power supply 102, and the lamp set is collectively referred to as a lamp system.

The ballast 100 includes an electromagnetic interference (EMI) filter and a rectifier (e.g., full-wave rectifier) 110, which are illustrated together in FIG. 1. The EMI filter portion of the EMI filter and rectifier 110 prevents noise that may be generated by the ballast 100 from being transmitted back to the AC power supply. The rectifier portion of the EMI filter and rectifier 110 converts AC voltage received from the AC power supply to rectified voltage. The rectifier portion of the EMI filter and rectifier 110 includes a first output terminal connected to a rectified bus 112 and a second output terminal connected to a ground potential at ground connection point 114. The rectifier portion of the EMI filter outputs a rectified voltage on the rectified bus 112. A first bus capacitor 116 is connected between the rectified bus 112 and the ground connection point 114. The first bus capacitor 116 conditions the rectified voltage transmitted via the rectified bus 112. A boost power factor control circuit 118 is connected to the rectified bus 112 for receiving the conditioned, rectified voltage and producing a high DC voltage bus 120 (also referred to throughout as a high DC bus 120). For example, in some embodiments, the boost power factor correction circuit 118 provides a voltage of substantially 450 volts to the high DC bus 120. A second bus capacitor 122, such as but not limited to an electrolytic capacitor, is connected between the high DC bus 120 and ground potential in a shunt configuration.

An inverter circuit 124 is connected to the boost power factor control circuit 118 and the second bus capacitor 122 via the high DC bus 120. The second bus capacitor 122 conditions the high DC bus providing a low impedance source of voltage to the inverter circuit 124. The inverter circuit 124, which in some embodiments is a half-bridge inverter, receives the conditioned high DC bus voltage and converts it to an alternating signal (e.g., AC voltage signal) in order to provide an alternating power signal to the lamp set 199. In FIG. 1, the ballast 100 includes a resonant circuit 126 connected to the inverter circuit 124. The resonant circuit 126 (e.g., a resonant inductor and a resonant capacitor) receives the alternating power signal from the inverter circuit 124, and in turn provides an alternating power signal (e.g., AC voltage) to the lamp set 199 via a hot filament 128, a common filament 130, and a cold filament 132. Thus, the boost power factor control circuit 118, the second bus capacitor 122, the inverter circuit 124, and the resonant circuit 126 comprise a lamp driver circuit 168 for driving the lamp set 199. It should be noted that the lamp driver circuit 168, in some embodiments, includes additional or alternative components, as known in the art, without departing from the scope of the invention.

As previously discussed, the lamp set 199 may include any number of lamps, such as the first lamp 191 and the second lamp 192 shown in FIG. 1, provided the lamps are each sensed in accordance with the sensing features discussed below. In FIG. 1, the resonant circuit 126 is configured to energize two lamps, the first lamp 191 and the second lamp 192. Each of the first lamp 191 and the second lamp 192 includes a first filament and a second filament, and each of the filaments includes a first terminal and a second terminal. The resonant circuit 126 includes the hot filament 128 with terminals 128*a* and 128*b*, the common filament 130 with terminals 130*a* and 130*b*, and the cold filament 132 with terminals 132*a* and 132*b*. The hot filament 128 is adapted for connecting across a first filament of the first lamp 191. The common filament output pair 130 is adapted for connecting to the terminals of the second filament of the first lamp 191 and to the terminals of the first filament of the second lamp 192 through common filament 130 terminals 130*a* and 130*b*, respectively. The cold filament 132 is connected across the second filament of the second lamp 192.

Still referring to FIG. 1, the ballast 100 also includes a control circuit 146, a protection circuit 150 comprising a latching circuit 158 and a fault detection circuit 166, a relamping (e.g., voltage rate of change, voltage slope, or dv/dt) circuit 154, and a voltage source circuit 142 (also referred to throughout as "a Vcc circuit 142"). The control circuit 146 is connected to the boost power factor control circuit 118 and to the inverter circuit 124 for controlling the operation of those components. The control circuit 146 is also connected to the cold filament 132 for sensing the cold filament 132 which indicates whether a lamp (e.g., the second lamp 192) of the lamp set 199 is connected to the ballast 100. If the control circuit 146 senses that a lamp of the lamp set 199 is not connected (e.g., disconnected, absent connection, unconnected), the control circuit 146 discontinues (e.g., disables, shuts down) the operation of the inverter circuit 124. In addition, the control circuit 146 is connected to the protection circuit 150, and is configured to discontinue (e.g., disable, shut down) the operation of the inverter circuit 124 if the protection circuit 150 detects a fault in the lamp system. As shown in FIG. 1, the voltage source circuit 142 is connected to the inverter circuit 124, the latching circuit 158, and the control circuit 146. As will be discussed below, the voltage source circuit 142 pulls voltage from the output of inverter circuit 124 and provides a supply voltage signal to the control circuit 146 as a function of the latching circuit 158. The fault detection circuit 166 is connected to the latching circuit 158 and detects a fault in the lamp system. In response to a detected fault, the latching circuit 158 inhibits the supply voltage signal from being provided to the control circuit 146 via the voltage source circuit 142. As such, the control circuit 146 is disabled, which in turn, disables the operation of the inverter circuit 124. Once the control circuit 146 has been disabled (e.g., "latched") by the latching circuit 158, the control circuit 146 remains latched until a reset signal provided. As described below, the reset signal may be, and some embodiments is, provided in response to an input power toggle, or in response to a relamping event detected by the relamping circuit 154.

Figure 2:
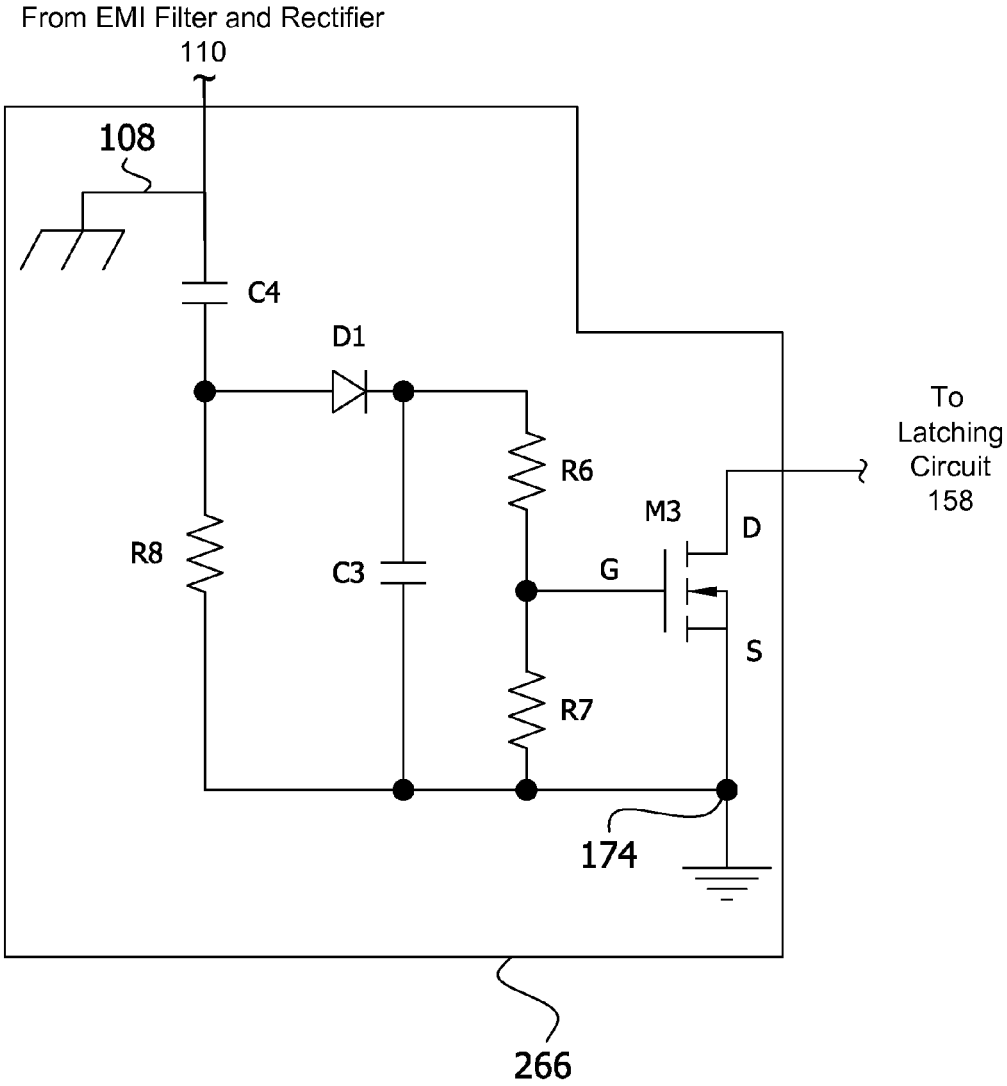
FIG. 2 is a circuit diagram of the fault detection circuit of the electronic ballast of FIG. 1 according to embodiments disclosed herein.

FIG. 2 is a circuit diagram of a fault detection circuit 266. The fault detection circuit 266 is a circuit for detecting a fault in compliance with Underwriters Laboratories (UL) standard 935. More particularly, the fault detection circuit 266 senses current flowing from earth ground (JGND) to power ground in order to detect a fault condition in the lamp system (e.g., lamp leakage). Although the fault detection circuit 266 is described herein as detecting a lamp leakage fault, it should be noted that other fault detection circuits may be used to detect various types of faults in the lamp system without departing from the scope of the invention. The fault detection circuit 266 comprises an earth ground node 108 and a power ground node 174. The earth ground node 108 is connected to the EMI filter and rectifier 110 shown in FIG. 1 and as described above. The fault detection circuit 266 also includes sensing components connected between the earth ground node 108 and the power ground node 174 for sensing the current flowing between the earth ground node 108 and the power ground node 174. The sensing components include, but are not limited to, a capacitor C3, a capacitor C4, a diode D1 having an anode and a cathode, a resistor R6, a resistor R7, and a resistor R8. The capacitor C4 is connected between the earth ground node 108 and the anode of the diode D1. The resistor R8 is connected between the anode of the diode D1 and the power ground node 174. The capacitor C3 is connected between the cathode of the diode D1 and the power ground node 174. The resistors R6 and R7 are connected in series between the cathode of the diode D1 and the power ground node 174.

A switching component M3 is connected between the sensing components and the latching circuit 158 shown in FIG. 1. More particularly, the switching component M3 is connected to a connection point between the series connected resistors R6 and R7, the latching circuit 158, and the power ground node 174. When the sensing components detect a lamp-to-earth ground fault condition, a voltage signal (e.g., voltage pulse) is provided via the switching component M3 to the latching circuit 158 in order to discontinue the operation of the inverter circuit 124. In FIG. 2, the switching component M3 is shown as a metal-oxide-semiconductor field-effect transistor (MOSFET) having a source terminal connected to the power ground node 174, a gate terminal connected to the connection point between the series connected resistors R6 and R7, and a drain terminal connected to the latching circuit 158. During normal operation (i.e., lamp-to-earth ground fault condition is not present), substantially no current flows from the earth ground node 108 to the power ground node 174. As such, substantially no voltage is produced across the resistor R8 (e.g., the voltage across the resistor R8 is approximately zero). Consequently, little or no voltage is provided at the gate terminal of the switching component M3, so the switching component M3 is off (e.g., open, in a non-conducting state). Accordingly, in the absence of a fault condition, the fault detection circuit 266 does not affect the normal operation of the lamp driver circuit 168 via the latching circuit 158. During a fault condition (e.g., a lamp-to-earth-ground fault occurrence), current flows from the earth ground node 108 to the power ground node 174, causing a nonzero voltage (i.e., a voltage having a threshold value that is greater than zero) to develop across the resistor R8. The threshold voltage across the resistor R8 is peak-detected by the diode D1 and the capacitor C3, providing a voltage at the gate terminal of the switching component M3 that causes the switching component M3 to turn on (e.g., closed, in a conducting state) and provides a voltage signal (e.g., voltage pulse) to the latching circuit 158. As described below, the latching circuit 158 receives the voltage pulse from the fault detection circuit 266 and, in response thereto, disables the control circuit 146, causing the operation of the inverter circuit 124 to cease.

Figure 3:
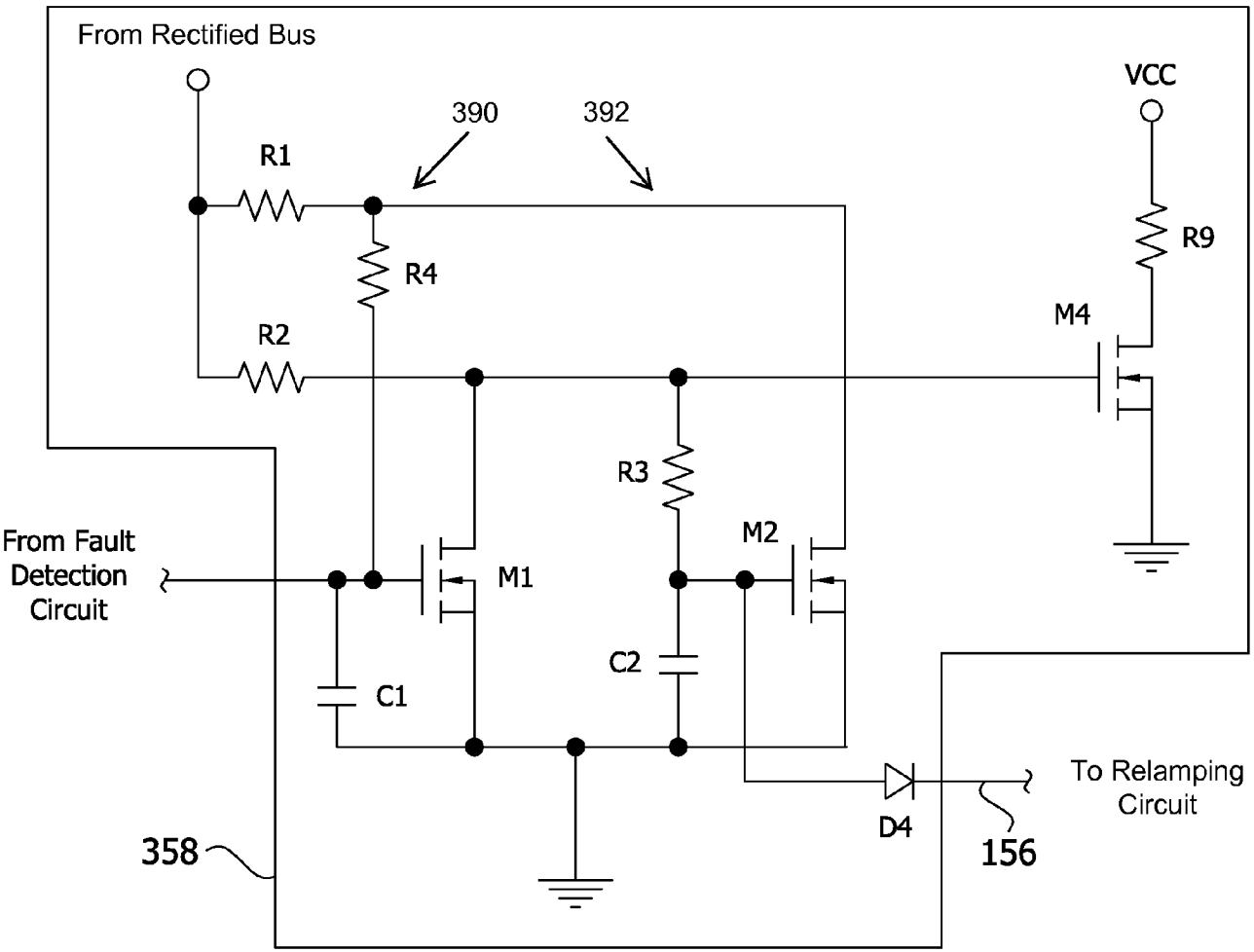
FIG. 3 is a circuit diagram of the latching circuit of the electronic ballast of FIG. 1 according to embodiments disclosed herein.

FIG. 3 is a circuit diagram of a latching circuit 358. The latching circuit 358 includes a first switching circuit 390 and a second switching circuit 392. The first switching circuit 390 comprises a first switch M1, which in FIG. 3 is a MOSFET having a gate, a source, and a drain, and a first set of impedance components, which include a capacitor C1, a resistor R1, and a resistor R4, having a first time constant. The second switching circuit 392 comprises a second switch M2, which in FIG. 3 is a MOSFET having a gate, a source, and a drain, and a second set of impedance components, which include a capacitor C2, a resistor R2, and a resistor R3, having a second time constant. The latching circuit 358 also includes a third switch M4, which in FIG. 3 is a MOSFET having a gate, a source, and a drain. The first switch M1, the second switch M2, and the third switch M4 each have a conductive state and a non-conductive state. The first switching circuit 390 and the second switching circuit 392 are connected together so that the first switch and the second switch operate complementary relative to each other between the conductive and non-conductive states. In other words, the first switch M1 and the second switch M2 are configured so that when the first switch M1 is operating in the conductive state, the second switch M2 is operating in the non-conductive state, and vice-a-versa. The third switch M4 is connected to second switch M2 such that the state of the third switch M4 is a function of the state of the second switch M2.

More particularly, the first switching circuit 390 and the second switching circuit 392 are each connected, via the rectified bus 112 of FIG. 1, to the EMI filter and rectifier 110 of FIG. 1 for receiving the rectified voltage signal. The resistor R1 is connected between the rectified bus 112 and the resistor R4. The resistor R4 is also connected to the gate of the first switch M1. The capacitor C1 is connected between the gate and the source of the first switch M1. The resistor R2 is connected in series with the resistor R3, the series connected resistors R2 and R3 connected between the rectified bus 112 and the gate of the second switch M2. The capacitor C2 is connected between the gate and the source of the second switch M2. The source of the first switch M1 and the source of the second switch M2 are both connected to ground. The drain of the first switch M1 is connected between the series connected resistors R2 and R3. The drain of the second switch M2 is connected between the resistor R1 and the resistor R4. The gate of the third switch M4 is connected between the series connected resistors R2 and R3. The source of the third switch M4 is connected to ground. The drain of the third switch M4 is connected to a resistor R9, which is also connected to the voltage supply circuit 142 (i.e., the Vcc circuit 142 of FIG. 1). The gate of the first switch M1 is connected to the fault detection circuit 166/266, and the gate of the second switch M2 is connected to a anode of a diode D4. The cathode of the diode D4 is connected to the relamping circuit, specifically, to an output 156 of the relamping circuit.

In some embodiments, the first time constant is less than the second time constant (alternative configurations are contemplated and within the scope of the invention). As such, when the ballast 100 begins receiving power from the power supply 102, the first switch M1 operates in the conductive state (e.g., "ON"). Since the first switching circuit 390 and the second switching circuit 392 are connected in a complementary fashion, as described above, the second switch M2 and the third switch M4 (connected to the second switch M2) both operate in the non-conductive state (e.g., "OFF"). The first switch M1 is configured to switch states in response to receiving the voltage pulse from the fault detection circuit 166/266. Thus, when the ballast 100 is energized and the first switch M1 receives a voltage pulse from the fault detection circuit 166/266 indicating that a fault has occurred, the first switch M1 switches to the non-conductive state (e.g., "OFF"), causing the second switch M2 and the third switch M4 to switch to the conductive state (e.g., "ON"). Due to the connection of the third switch M4 to the voltage supply circuit 142 and to ground described above, when the third switch M4 is switched to its conductive state in response to the fault occurrence, the supply voltage provided by the Vcc circuit 142 to the control circuit 146 is drained. As such, the operation of the control circuit 146 is disabled, causing the operation of the inverter circuit 124 to discontinue. The second switch M2, and thereby the third switch M4, remains in the conductive state until a reset signal is provided to the second switch M2 by the relamping circuit 154. The diode D4 prevents false triggering of the second switch M2. In this way, the latching circuit 358 latches the control circuit 146 in the disabled state in response to a fault until a reset event occurs. When the reset signal is provided to the second switch M2 by the relamping circuit 154, it causes the second switch M2 and the third switch M4 to switch to non-conductive states and the first switch M1 to switch to the conductive state. As such, the latching circuit 358 no longer pulls down the voltage supply signal provided to the control circuit 146, so the control circuit 146 is able to receive the voltage supply signal and thus operate the inverter circuit 124 to energize the lamp set.

Figure 4:
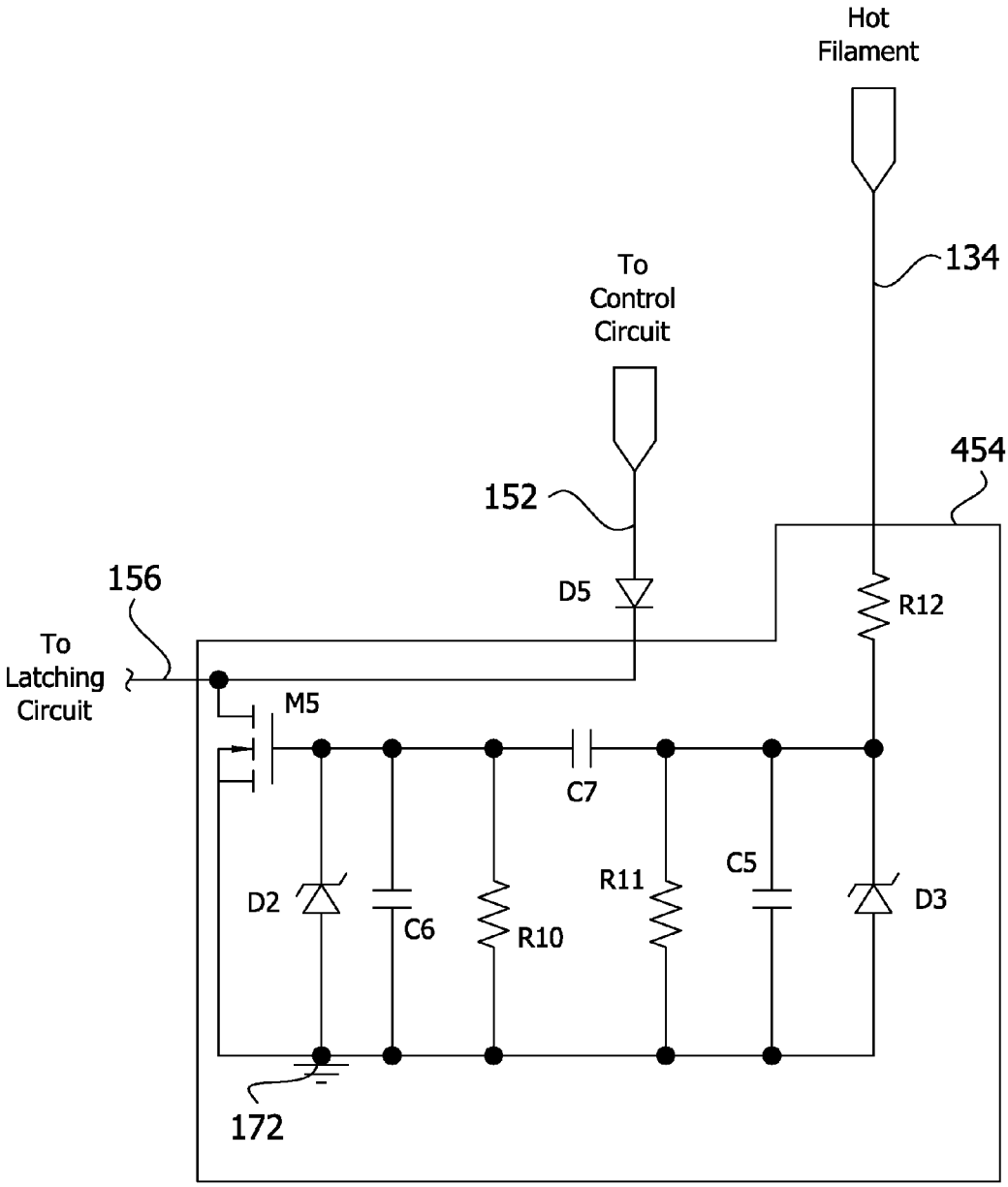
FIG. 4 is a circuit diagram of the relamping circuit of the electronic ballast of FIG. 1 according to embodiments disclosed herein.

FIG. 4 is a circuit diagram of a relamping circuit 454. The relamping circuit 454 is connected at an input terminal 134 to the hot filament 128 of FIG. 1 for detecting a relamping event. The relamping circuit 454 is also connected to the control circuit 146 of FIG. 1 for providing an input toggle reset to the control circuit 146. In response to detecting a relamping event, the relamping circuit 454 generates a reset signal and provides the reset signal to the latching circuit 158/358, for example but not limited to via the second switch M2 of the latching circuit 358 as described above. The latching circuit 158/358 also resets when input toggling occurs, since the latching circuit 158 is energized from the rectified bus 112. In the event of an input toggle, there is initially no voltage across the first bus capacitor 116 of FIG. 1. When the ballast 100 is re-energized, the latching circuit 158/358 returns to normal operation.

In some embodiments, the relamping circuit 454 includes a MOSFET M5 having a gate, a source, and a drain, a diode D5 having an anode and a cathode, a Zener diode D2 having an anode and a cathode, a Zener diode D3 having an anode and a cathode, a resistor R10, a resistor R11, a resistor R12, a capacitor C5, a capacitor C6, and a capacitor C7. The resistor R12 is connected between the input terminal 134 and the cathode of the Zener diode D3. The anode of the Zener diode D3 is connected to a ground node 172. The capacitor C5 is in parallel with the Zener diode D3. The resistor R11 is in parallel with the Zener diode D3. The capacitor C7 is connected between the resistor R11 and the resistor R10. The resistor R10 is also connected to the ground node 172. The capacitor C6 is in parallel with the resistor R10. The Zener diode D2 is in parallel with the resistor R10. The cathode of the Zener diode D2 is connected to the gate of the MOSFET M5. The source of the MOSFET M5 is connected to the ground node 172. The drain of the MOSFET M5 is connected to the latching circuit. The drain of the MOSFET M5 is also connected to the cathode of the diode D5, and the anode of the diode D5 is connected the control circuit.

In accordance therewith, the relamping circuit 454 exhibits an essentially stable voltage during steady state operation of the ballast 100. When the lamps of the lamp set 199 are operating in a normal fashion, the average voltage at the input terminal 134 (i.e., the gate terminal of the MOSFET M5) is essentially stable and therefore devoid of drastic fluctuations in average voltage. Consequently, the voltage across the capacitor C7 maintains a relatively constant value. More particularly, the capacitors C5 and C7 are both peak-charged and conduct little or no current. As such, ultimately little or no voltage is present across resistor the R10, and the MOSFET M5 is in its non-conductive state (i.e., "OFF"). Thus, during normal operation of the lamp set 199, the relamping circuit 454 exerts no effect upon the latching circuit 158/358 or the control circuit 146. On the other hand, during a relamping event (e.g., a lamp fails and must be removed and replaced with a new lamp), when a lamp is removed (e.g., disconnected from the ballast 100), the input terminal 134 to the relamping circuit 454 becomes open. The voltages across the capacitors C5 and C7 decay as they discharge; this voltage drops to zero if a lamp is not installed within a period of time. Upon reinstallation, the voltage at the input terminal 134 of the relamping circuit 454 increases extremely rapidly, causing a considerable amount of current to flow into the capacitors C6 and C7, which in turn causes a large enough voltage to develop across the resistor R10 (e.g., 0.7 volts or greater) to momentarily turn the MOSFET M5 "ON" (i.e., place the MOSFET M5 in its conducting state). At this point, outputs 156 and 152 of the relamping circuit 454 (which are inputs to, respectively, the latching circuit 158/358 and the control circuit 146) are coupled to the ground node 172. This ground coupling disengages the latching circuit 158/358, and allows the lamp driver circuit 168 to begin to operate. Consequently, the inverter circuit 124 will start up and remain on long enough to ignite the replacement lamp, if the lamp is indeed capable of normal ignition and operation. The MOSFET M5 will remain on for a limited period of time and preferably for only as long as it reasonably takes to restart the inverter circuit 124 and ignite the replacement lamp. By the end of this limited period of time, the peak value of the voltage at the input terminal 134 of the relamping circuit 454 stabilizes, with the result that the capacitor C7 becomes peak charged. Thus, no current flows through the capacitor C7 and the MOSFET M5 turns "OFF". In this way, the MOSFET M5 is only "ON" for a limited period of time. As such, in cases where a defective lamp is installed, the relamping circuit 454 does not permanently disable the inverter protection circuit 150 but, after a brief delay, allows the inverter protection circuit 150 to proceed with its intended function of shutting down and protecting the inverter circuit 124 in response to a lamp fault condition.

In some embodiments, the above-described components of the fault detection circuit 166/266, the latching circuit 158/358, and the relamping circuit 154/454 are configured to operate as shown in Table 1 below.

TABLE 1

| CONDITION | M1 | M2 | M3 | M4 | M5 | VCC SIGNAL |
|---|---|---|---|---|---|---|
| NORMAL OPERATION | ON | OFF | OFF | OFF | OFF | HIGH |
| FAULT OCCURRENCE | OFF | ON | PULSE ON | ON | OFF | LOW |
| RELAMP EVENT | ON | OFF | OFF | OFF | PULSE ON | HIGH |

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A ballast comprising:

a rectifier configured to receive an alternating current (AC) voltage signal from a power source and to produce a rectified voltage signal therefrom;

an inverter circuit configured to receive the rectified voltage signal and to provide an oscillating voltage signal to energize one or more lamps;

a control circuit connected to the inverter circuit and configured to control operation of the inverter circuit;

a voltage supply circuit connected to the control circuit and configured to provide a supply voltage to the control circuit so as to power the control circuit;

a fault detection circuit connected to the one or more lamps and configured to detect a fault condition and, in response, to generate a voltage pulse; and a latching circuit connected to the fault detection circuit and configured to disable the control circuit so that operation of the inverter circuit is discontinued during a fault condition, the latching circuit comprising:

a first switching circuit comprising a first switch, wherein the first switching circuit is connected to the rectifier and is configured to receive the rectified voltage signal from the rectifier, wherein the first switch includes a conductive state and a non-conductive state, and wherein the first switch is connected to the fault detection circuit and configured to switch states in response to receiving the voltage pulse from the fault detection circuit;

a second switching circuit comprising a second switch, wherein the second switching circuit is connected to the first switching circuit and to the rectifier and is configured to receive the rectified voltage signal, wherein the second switch includes a conductive state and a non-conductive state, and wherein the second switch and the first switch are configured to operate complementary relative to each other between the conductive state and the non-conductive state; and a third switch having a conductive state and a non-conductive state, wherein the third switch is connected to the second switch so that the state of the third switch is a function of the state of the second switch, and wherein the third switch is connected to the voltage supply circuit so that the supply voltage to the control circuit is drained when the third switch operates in the conductive state and the control circuit is thereby disabled.

2. The ballast of claim 1, further comprising:

a relamping circuit configured to detect a relamping event and generate a voltage pulse in response to so detecting, the relamping circuit connected to the second switch of the latching circuit to provide the voltage pulse thereto, wherein the second switch of the latching circuit is configured to switch states in response to receiving the voltage pulse from the relamping circuit.

3. The ballast of claim 1, wherein the first switching circuit further comprises a first resistor-capacitor (RC) circuit having a first time constant, and the second switching circuit further comprises a second RC circuit having a second time constant.

4. The ballast of claim 3, wherein the first time constant is less than the second time constant.

5. The ballast of claim 1, wherein the fault detection circuit comprises a power ground node and an earth ground node, and wherein the fault detection circuit is configured to detect a fault condition based on current flow between the power ground node and the earth ground node.

6. The ballast of claim 5, wherein the earth ground node of the fault detection circuit is connected to the rectifier.

7. The ballast of claim 1, wherein the first switch is configured to switch from a conductive state to a non-conductive state in response to receiving the voltage pulse from the fault detection circuit.

8. The ballast of claim 1, wherein the latching circuit is configured so that the second switch and the third switch change from a non-conductive state to a conductive state in response to detection of a fault condition by the fault detection circuit.

9. The ballast of claim 1, wherein the ballast is configured to connect to a first lamp and a second lamp, and the one or more lamps comprises the first lamp and the second lamp.

10. A ballast, comprising:

a lamp driver circuit configured to drive one or more lamps;

a control circuit connected to the lamp driver circuit to control operation of the lamp driver circuit;

a voltage supply circuit connected to the control circuit to provide a supply voltage to the control circuit to power the control circuit;

a fault detection circuit configured to connect to the one or more lamps to detect a fault condition and generate a voltage pulse in response to so detecting; and a latching circuit connected to the fault detection circuit to disable the control circuit so that operation of the lamp driver circuit is discontinued during a fault condition, the latching circuit comprising:

a pair of complementary switches, wherein the pair of complementary switches comprises a first switch and a second switch; and a third switch configured to operate between a conductive state and a non-conductive state as a function of the second switch, wherein the third switch is connected to the voltage supply circuit so that the supply voltage to the control circuit is drained when the third switch operates in the conductive state and the control circuit is thereby disabled.

11. The ballast of claim 10, wherein the first switch and the second switch each operate between a conductive state and a non-conductive state, and wherein the first switch is connected to the fault detection circuit and configured to switch states in response to receiving the voltage pulse from the fault detection circuit.

12. The ballast of claim 10, wherein the lamp driver circuit is configured to drive a first lamp and a second lamp.

13. The ballast of claim 10, further comprising a rectifier to receive an alternating current (AC) voltage signal from a power source and provide a rectified voltage signal to the lamp driver circuit.

14. The ballast of claim 13, further comprising a first resistor-capacitor (RC) circuit and a second RC circuit, wherein the first RC circuit is connected to the rectifier and to the first switch of the latching circuit, and wherein the second RC circuit is connected to the rectifier and to the second switch of the latching circuit.

15. The ballast of claim 14, wherein the first RC circuit has a first time constant, and the second RC circuit has a second time constant that is greater than the first time constant.

16. The ballast of claim 10, further comprising a relamping circuit to detect a relamping event and generate a voltage pulse in response to the detecting, the relamping circuit connected to the second switch of the latching circuit to provide the voltage pulse thereto, wherein the second switch of the latching circuit is configured to turn-off in response to receiving the voltage pulse from the relamping circuit.

17. The ballast of claim 10, wherein the fault detection circuit comprises a power ground node and an earth ground node, and wherein the fault detection circuit is configured to detect a fault condition based on current flow between the power ground node and the earth ground node.

18. The ballast of claim 10, wherein the first switch is configured to switch from a conductive state to a non-conductive state in response to receiving the voltage pulse from the fault detection circuit.

* * * * *